United States Patent [19]

Petkov et al.

[11] Patent Number: 4,660,326

[45] Date of Patent: Apr. 28, 1987

[54] APPARATUS FOR HYDROMECHANICAL CLEANING AND POLISHING

[75] Inventors: Georgi K. Petkov; Bencho P. Kyurkchiev; Valentin Y. Barzakov; Stefan P. Minchev, all of Gabrovo, Bulgaria

[73] Assignee: N P S P PO Hydroplastichna Obrabotka na Metalite, Gabrovo, Bulgaria

[21] Appl. No.: 824,730

[22] Filed: Jan. 31, 1986

[30] Foreign Application Priority Data

Jan. 31, 1985 [BG] Bulgaria ..... 68621

[51] Int. Cl.[4] ..... B24B 19/00; B24B 31/00

[52] U.S. Cl. ..... 51/7; 51/17; 51/317

[58] Field of Search ..... 51/7, 5 R, 4, 22, 317, 51/411, 17, 323, 313, 292

[56] References Cited

U.S. PATENT DOCUMENTS 2,802,228 8/1957 Federighi ..... 51/17

FOREIGN PATENT DOCUMENTS 675643 7/1952 United Kingdom ..... 51/7
129106 11/1959 U.S.S.R. ..... 51/7
141404 11/1960 U.S.S.R. ..... 51/7
288585 1/1971 U.S.S.R. ..... 51/7

*Primary Examiner*—Frederick R. Schmidt
*Assistant Examiner*—Bradley I. Vaught

[57] ABSTRACT

An apparatus, consisting of a movable casing connected to a drive mechanism. A chamber is arranged in the movable casing and filled with working medium. The movable casing has a diaphragm connected with a mechanism for backward and forward movement. The movable casing is horizontal and the diaphragm, of which there is at least one, is mounted in the chamber of the movable casing on a sliding coupling. The working medium is a mixture of spheres and working fluid, and the movable casing is connected with a working fluid source.

2 Claims, 4 Drawing Figures

APPARATUS FOR HYDROMECHANICAL CLEANING AND POLISHING

Figure 1:
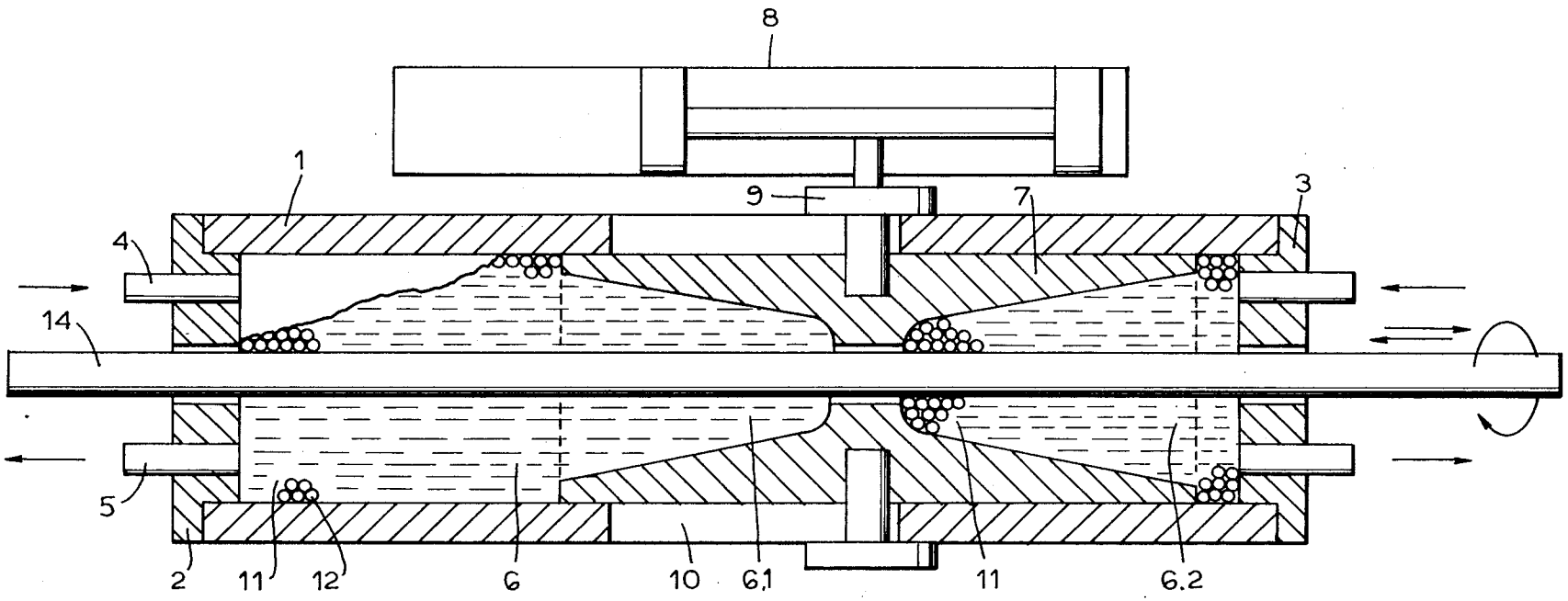

The invention is an apparatus for hydromechanical blasting and polishing which can be utilized in machine construction and metallurgy for the polishing and cleaning of wire, rolled bars or billets of limited or unlimited lengths.

There is known in the art (USSR Certificate of Authorship No. 641505), an apparatus for cleaning and polishing of wire which consists of a tank of liquid cleaner in which is mounted a freely supported lower roller. Two upper rollers are mounted outside of the tank over the lower roller. The wire being treated is rolled up on a drum, and an infinite cord runs through and between the two upper rollers and the lower roller so that the treated wire is surrounded by it in the form of a helix spiral. The infinite cord is constantly moistened by the liquid cleaner. The system of rollers is connected to a drive mechanism.

One disadvantage of the apparatus is that a low contact pressure results between the wire being treated and the infinite cord, which necessarily means a lesser quality of the treated upper surface. A further disadvantage results from the thinning of the infinite cord as it works under conditions of tensile stress, making it progressively more and more prone to damage, thus reducing the reliability of the apparatus. Still another disadvantage is that the abrasive properties of the infinite cord decrease during the course of the work as there is no means available for refurbishing or replacing its working surface. This results in the reduction of the quality of the treated upper surface, and a lowering in the rate of productivity.

There is also known in the art (USSR Certificate of Authorship No. 288585) an apparatus for cleaning of billets with unlimited length which consists of a vertically arranged movable casing and is connected with a drive mechanism. An opening is arranged at the lower portion of the movable casing and a diaphragm is mounted on its upper portion which is connected to a mechanism for backward and forward movement. This apparatus is cam shaped, and comes into contact with the diaphragm. The cam is connected to a centrifugal mechanism which is mounted onto the movable casing. A chamber is arranged in the movable casing which is filled with the working medium.

One disadvantage of this apparatus is that only the working medium, located around the billet that is being cleaned, is utilized in the cleaning process, and because there are no provisions for its constant renewal, it is quickly saturated with the oxides that have separated from the billet, thereby diminishing its cleaning properties. A further disadvantage is that in order to renew the working medium, and replenish its cleaning properties, necessitates stopping the entire operation, and exchanging the working medium which reduces the productivity of the cleaning and polishing process.

The invention addresses the problem of developing an apparatus for hydromechanical cleaning and polishing which guarantees a high contact pressure between the outer surfaces to be treated and the working medium with the constant renewal of the working outer surface medium, whereby the quality of the treated outer surface, the productivity of the process, and the reliability of the apparatus is improved.

This problem is solved with an apparatus consisting of a movable casing that is connected with a drive mechanism. A chamber is arranged in the the movable casing filled with the working medium. The movable casing has a diaphragm which is connected to a device for backward and forward movement. The movable casing is horizontal according to the invention and the diaphragm, of which there is at least one, is mounted in the chamber of the movable casing on a sliding coupling. The working medium is a mixture of spheres and working fluid, and the movable casing is connected with a source of the working medium.

One variation of the apparatus has a diaphragm arranged in the chamber of the movable casing so as to form left and right chambers of proportionately variable volumes. The movable casing is closed with a left and a right cap, each of which has a inlet and outlet connection arranged in it. The movable casing is thereby connected with the source of the working medium.

In another variation of the apparatus the walls of the movable casing are perforated and it is arranged within a housing. An inlet and outlet is arranged in the housing through which it is connected with the source of the working medium. A stationary mounted dividing wall is in the center of the chamber of the movable casing which forms left and right chambers. There are two diaphragms, one left and one right, which are mounted in the movable casing by way of movable longitudinal couplings. Each of the two diaphragms are driven separately.

One improvement of the present apparatus is that a constant renewal of the working surfaces of the spheres, as well as a regeneration of the working fluid is guaranteed, whereby constant cleaning and polishing properties are achieved with the working fluid. This results in high processed surface quality and an increase in the rate of productivity.

An additional improvement is that it is possible to regulate the contact pressure between the treated surface and the working medium, such that it is sufficiently high for achieving a high quality treated surface.

Another improvement is that the circulation of the working fluid allows the metal oxides, that separate from the treated surface of the billet, to be washed away and removed from the working area.

Figure 2:
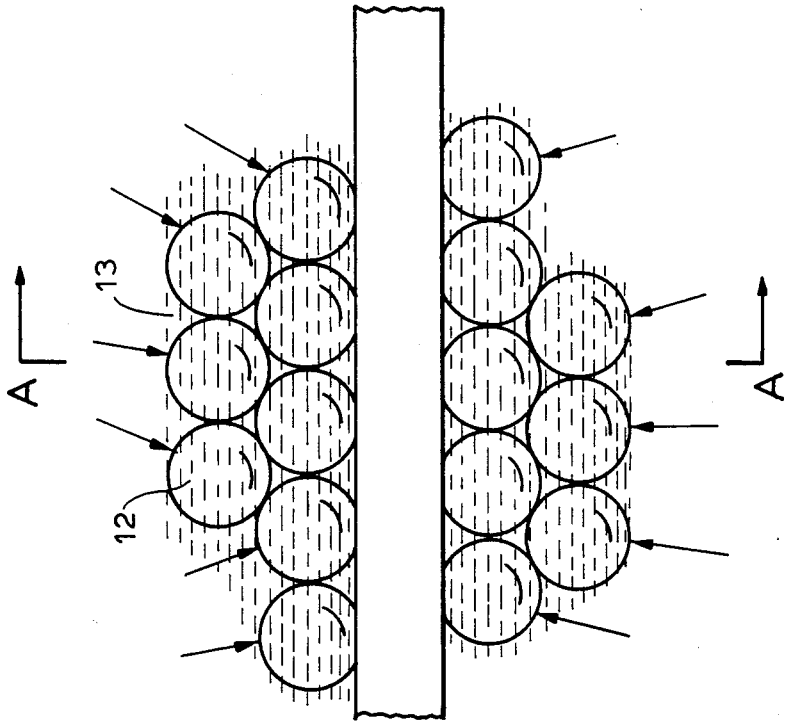

These and other objects and features of the invention will become apparent with reference to the following specification and to the drawings wherein:

FIG. 1: is a schematic longitudinal view of the first embodiment of the invention;

FIG. 2: is a diagram of the contact between the treated billet and the working medium.

Figure 3:
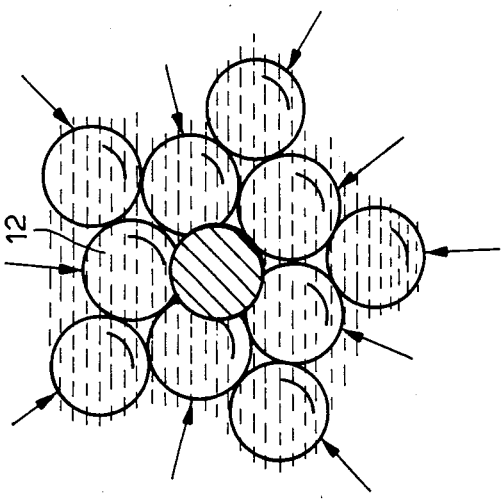

FIG. 3: is a cross section along A—A in FIG. 2

Figure 4:
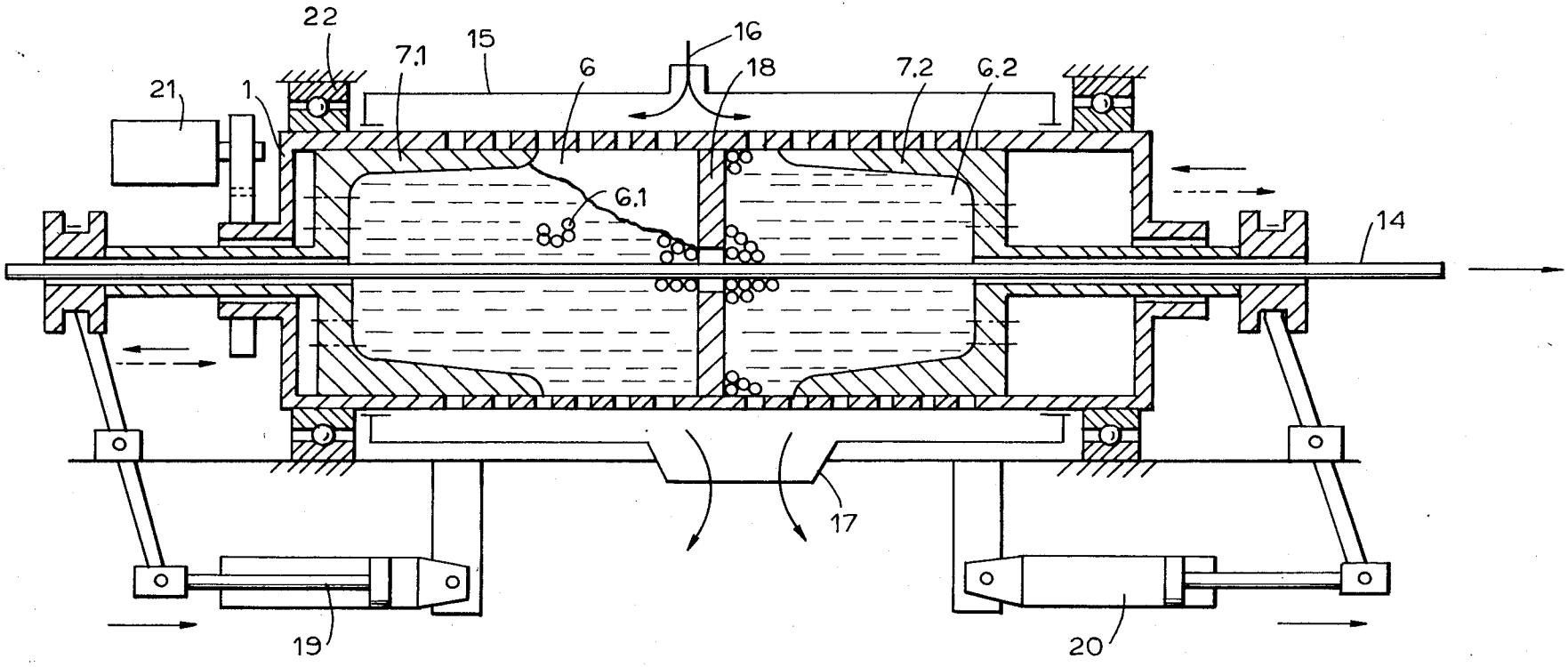

FIG. 4: a schematic longitudinal view of a second embodiment of the invention.

The first embodiment of the invention, which can be utilized for the treatment of billets of limited length consists, according FIG. 1, comprises a movable casing 1 on which is rigidly fastened a left cap 2 and right cap 3. An inlet connection 4 and an outlet connection 5 are mounted on each cap, which, in turn, are connected with a working fluid source (not shown in the drawing). A chamber 6 is arranged in the movable casing 1 containing a diaphragm 7 arranged in such a way that a left chamber 6.1, and a right 6.2 chamber are formed with proportionately variable volumes. The diaphragm 7 is connected to a hydraulic type mechanism 8, for backward and forward movement, by way of pins 9 arranged in grooves 10 located in the movable casing 1. The chamber 6 is filled with working medium 11 containing a mixture of spheres 12 and working fluid 13. The movable casing 1 is connected to a drive mechanism (not shown in the drawing) supplying the backward and forward longitudinal movement independent of the movement of the diaphragm 7. It is possible to transfer this movement to the treated billet 14 instead of the movable casing 1. This is only possible in the treatment of billets of limited length.

In the second embodiment of the invention, according FIG. 4, which is applicable for treatment of billets of unlimited length, the casing 1 with perforated walls is placed within a housing 15. The housing has installed in it an inlet opening 16 and an outlet opening 17 through which it is connected with the source of the working fluid (not shown in the drawing). In the center of the chamber 6 of the movable casing 1 a movable dividing wall 18 is mounted. The same forms a left chamber 6.1, and a right chamber 6.2. There are two diaphragms 7 in this variation, one left diaphragm 7.1, and one right diaphragm 7.2. The same are mounted as longitudinal movable couplings in the movable casing 1, and are driven independently and respectively by a left hydraulic cylinder 19, and a right hydraulic cylinder 20. A mechanism 21 is mounted on the movable casing 1 for drive purposes, which in this instance is of the electromagnetic type and provides the rotating motion. The movable casing 1 is located in a support 22. Each diaphragm, the left 7.1 and the right 7.2, can have a perforated vertical wall for purposes of better circulating the working fluid 13.

It is possible to mount the apparatus in series of two or more for purposes of better treatment of the billet.

The method of operation of the apparatus according to the first variation is as follows: The billet of limited length 14 goes through the opening in the left cap 2, the diaphragm 7 and the right cap 3. The chamber 6, the left chamber 6.1 and the right chamber 6.2 of the apparatus are filled with working medium 11. The diaphragm 7 is displaced to the right by means of the mechanism for backward and forward movement 8, and the pins 9 guided in the grooves 10 until it seals the working medium 11 around the billet 14. At the same time, in the left chamber 6.1, the spheres 12 undergo a regeneration and washing off from the working medium 11, by means of the working fluid 13. At the same time, rotary and a backward and forward movement is imparted onto the billet 14. Thereafter the diaphragm 7 is displaced to the left by means of the mechanism for backward and forward movement 8 until it seals the working medium 11 in the left chamber 6.1, whereby the working medium 11 in the right chamber 6.2 is removed for regeneration and washing off of the metal oxides and the separated abrasive particles. In this way, multiple contact pressure of the spheres is realized during the treatment on the surface of the billet 14 (FIG. 2 and FIG. 3). During the operation, the working fluid 13 continuously circulates between the spheres 12, thereby cooling the contact area and washing off the metal oxides and the separated abrasive particles through the outlet connection 5.

In first embodiment of the invention the movable casing 1 performs a backward and forward movement while the billet 14 remains fixed in the axial direction while only having a rotary movement.

The method of operation of the apparatus according to the second embodiment (FIG. 4) is as follows: The billet 14 of unlimited length is guided through the diaphragm 7.1, the left chamber 6.1, the fixed dividing wall 18, the right chamber 6.2 and the right diaphragm 7.2. The movable casing 1 is rotated by means of a drive mechanism 21. The left diaphragm 7.1 is displaced to the right by means of the left hydraulic cylinder 19 whereby the working fluid 13 is sealed. In this way the right diaphragm 7.2, in the right chamber 6.2, is displaced to the right end position by means of the right hydraulic cylinder 20 for purposes of regenerating and washing off of the working medium 11 by means of the working fluid 13, which flows through the inlet opening 16 of the housing 15 and the perforated openings of the movable casing 1 and leaves the space through the outlet opening 17. A constant, uninterrupted pressure is achieved of the working medium 11, i.e. the spheres 12 and the working fluid 13, on the treated outer surface of the billet 14, by cyclical switching of the right 7.1, and the left 7.2 diaphragms.

We claim:

1. An apparatus for hydromechanical cleaning and polishing comprising a movable casing connected to a drive mechanism the said movable casing having a chamber filled with a working medium and furnished with two diaphragms which are provided with a mechanism for backward and forward movement wherein said movable casing is horizontal and the said diaphragms are mounted in the chamber of the said movable casing on a sliding coupling, whereby the said working medium is a mixture of spheres and working fluid, and further, wherein said movable casing has perforated walls and is arranged in a housing which has an inlet opening and an outlet opening through which the said working fluid can enter and exit, wherein a movable dividing wall is mounted in the center of the chamber of the said movable casing, forming left and right chambers, and the two diaphragms, one left and one right, are mounted on movable longitudinal couplings in the movable casing, wherein each is driven independently.

2. An apparatus according to claim 1, wherein said diaphragms are arranged in the chamber of the movable casing in such a way that there is a left chamber and a right chamber that are formed with variable volumes.

* * * * *